United States Patent [19]

Gordon et al.

[11] Patent Number: 4,583,680

[45] Date of Patent: Apr. 22, 1986

[54] SERVING CONTAINER WITH PAPERBOARD BASE PLATE

[75] Inventors: Robert L. Gordon, Monroe; Michael Bodary, Middletown; Andrew J. Alba, Warwick, all of N.Y.

[73] Assignee: International Paper Company, New York, N.Y.

[21] Appl. No.: 665,191

[22] Filed: Oct. 26, 1984

[51] Int. Cl.[4] ..... B65D 45/00

[52] U.S. Cl. ..... 229/45 R; 229/4.5; 229/5.5

[58] Field of Search ..... 229/45 R, 93, 4.5, 5.5, 229/43

[56] References Cited

U.S. PATENT DOCUMENTS

| | | | |
|---|---|---|---|
| 1,683,192 | 9/1928 | Huye . | |
| 2,025,589 | 12/1935 | Huye | 229/23 |
| 2,461,581 | 2/1949 | Wilson | 229/5.5 |
| 2,559,320 | 7/1951 | Rushing et al. | 229/43 |
| 2,652,969 | 9/1953 | Pfaff | 229/33 |
| 2,713,963 | 7/1955 | Andrews et al. | 229/33 |
| 3,019,957 | 2/1962 | Palmer | 229/16 |
| 3,027,062 | 3/1962 | Huss et al. | 229/23 |
| 3,303,964 | 2/1967 | Luker | 220/97 |
| 3,361,323 | 1/1968 | Adams et al. | 229/23 |
| 3,465,944 | 9/1969 | Robinson | 229/5.5 |
| 3,490,679 | 1/1970 | Heller et al. | 229/23 |
| 3,547,336 | 12/1970 | Jacke | 229/16 |
| 3,595,428 | 7/1971 | Mounts | 220/42 R |
| 3,633,785 | 1/1972 | Cyr et al. | 220/20 |
| 3,642,194 | 2/1972 | Scully | 229/51 |
| 3,670,951 | 6/1972 | Smith | 229/43 |
| 3,675,811 | 7/1972 | Artz | 220/20 |
| 3,690,902 | 9/1972 | Dahl | 99/172 |
| 3,770,115 | 11/1973 | Cannell | 206/45.32 |
| 3,780,187 | 12/1973 | Bard et al. | 426/113 |
| 3,815,736 | 6/1974 | Sedlak | 206/501 |
| 3,851,789 | 12/1974 | Case et al. | 220/307 |
| 3,966,112 | 6/1976 | Gordon | 229/23 |
| 4,234,097 | 11/1980 | Daenen | 220/4 D |
| 4,291,829 | 9/1981 | Vanderlugt, Jr. | 229/43 |

FOREIGN PATENT DOCUMENTS 640589 5/1962 Italy .

*Primary Examiner*—Joseph Man-Fu Moy
*Attorney, Agent, or Firm*—Richard J. Ancel

[57] ABSTRACT

A serving container for a food product such as a hamburger. The bottom of the container is in the form of a flat plate having an upstanding rim near its periphery and is formed of paperboard. The top or crown of the container is an inverted cup formed of paperboard. The lower edge of the crown carries integral tabs which resiliently and releasably fasten into slots in an upstanding V rim of the plate. The plate serves as a base upon which the food product may be built. The crown functions to retain heat and emit moisture and may serve the additional function of a receptacle for another food product, such as french fries or salad, when the serving container is used in a so-called fast food restaurant. In food outlets serving hamburgers of different thicknesses, different height crowns alone need be stocked thus reducing container inventory. The number of locking tabs carried by the lower rim of the crown is significantly greater than the number of slots in the V rim, thereby assuring engagement of at least most of the slots, to thereby join the crown to the plate.

6 Claims, 4 Drawing Figures

SERVING CONTAINER WITH PAPERBOARD BASE PLATE

BACKGROUND OF THE INVENTION

This invention relates to a serving container construction for a food product, such as a hamburger or other so-called fast food product.

In the dispensing of food products such as hamburgers from fast food outlets, it is usually the custom to provide serving containers for each hamburger. Often, the hamburgers are built or formed, then transferred to a serving container, a plurality of serving containers being stacked in a heated holding bin for sequential distribution to purchasers. The hamburgers are often of different sizes, with size differential usually due to the height of the hamburger and not its diameter. Thus, a smaller hamburger may contain a single meat patty with condiments or other fillings, while a larger hamburger will have several meat patties. In order to accommodate hamburgers of various heights, it is usually necessary either to maintain a supply of serving containers of different sizes, or, alternatively, to inventory one serving container which will accommodate the largest size hamburger. If the first option is elected, greater storage area is required for the different sizes. If the second option is elected, the use of larger serving containers than required clearly represents a waste of material.

SUMMARY OF THE INVENTION

According to the practice of this invention, most of these disadvantages are overcome by the use of a serving container formed of two separable portions. The first portion is a lower or plate portion and the second is an upper or crown portion. The crown is in the form of an inverted cup whose open rim releasably attaches to a complementary and upstanding rim around the peripery of the lower plate member. In use, the fast food outlet need only inventory a single size plate, with different height crowns being stocked for different size hamburgers. Both the crown and the plate are formed of paperboard. The lower rim of the crown is provided with a plurality of tabs, the tabs releasably locking with slots on an upstanding rim portion of the plate.

The full nature of the invention will be understood from the accompanying drawings and the following description and claims.

DETAILED DESCRIPTION OF THE INVENTION

Figure 1:
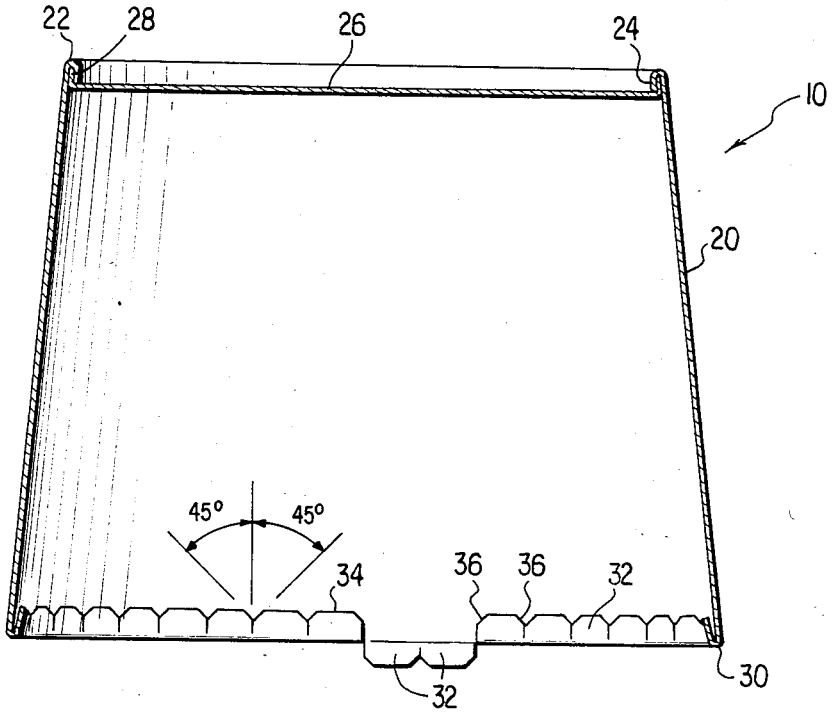
FIG. 1 is an elevational cross-section view of the upper or crown portion of the serving container of this invention.

Referring now to FIG. 1 of the drawings, the numeral 10 denotes generally the upper or crown portion of the serving container of this invention and is defined by an inverted, cup-shaped member whose sloping walls 20 define a conical surface. The upper rim of conical wall 20 terminates in a bight portion 22 integral with a downwardly extending terminal rim portion 24.

The numeral 26 denotes a closure panel in the form of a disc, whose radially outermost periphery terminates in upwardly extending rim portion 28, the latter being sandwiched between rim portion 24 and the uppermost portion of wall 20. An adhesive is employed to assemble the disc 26 in the indicated manner to the top portion of wall 20. For example, wall 20 and disc 26 may be formed of uncoated S.B.S. (solid bleached sulfate) paperboard or of S.B.S. paperboard coated with a layer of a plastics material, such as polyethylene, with conventional heat sealing employed to join the members together. The caliper of the S.B.S. board is in the range of 12 to 16 pt. The lowermost or open edge of wall 20 is denoted by the numeral 30. Edge 30 comprises the bight portions of a plurality of tabs 32, the tabs being integral extensions of wall 20. Each tab normally lies against the inner surface of wall 20, with its projecting tip defined by a horizontal edge 34 terminating at 45 degree cuts 36 on both ends. Tabs 32 lie near to but slightly spaced from the inner surface of wall 20, being bent back approximately 180 degrees from wall 20, the edges 34 thereby being slightly spaced from the wall so as to engage slots on the plate member, as later to be described. Tabs 32 are not glued to or ironed flat against wall 20, because it is preferred to use the natural resiliency of the paperboard that is created from fold or bight 30. FIG. 1 shows most of the tabs 32 bent towards wall 20 and also shows, for purposes of comprehension of tab geometry, two of the tabs bent away from this normal position and extending straight out from wall 20, from which all of the tabs are formed.

Figure 2:
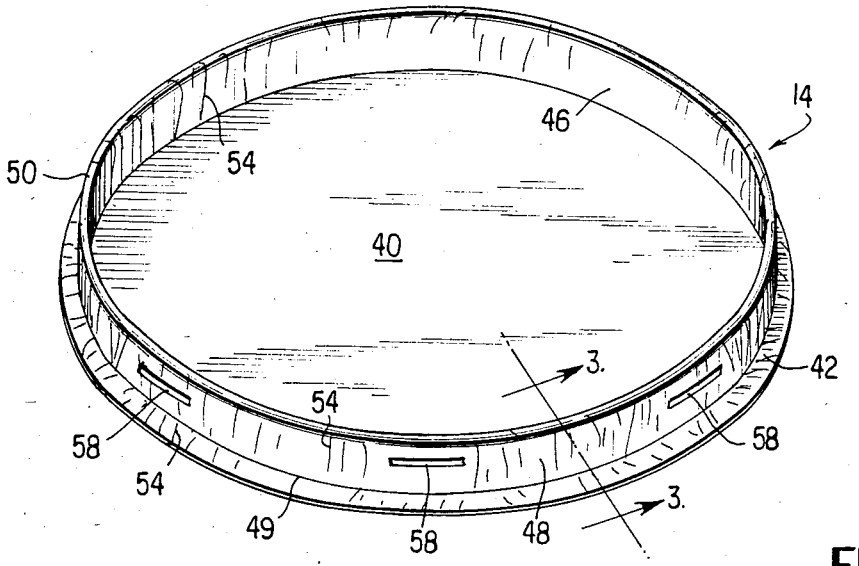
FIG. 2 is a perspective view of the lower or plate portion of the serving container of this invention.
Figure 3:
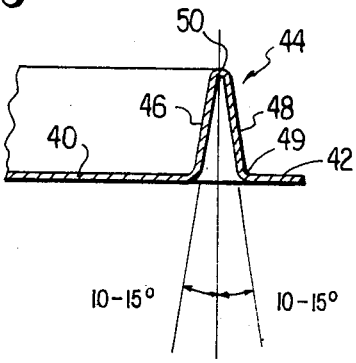
FIG. 3 is an elevated cross-section of the plate portion of FIG. 2, taken along section 3—3 of FIG. 2.

Referring now to FIGS. 2 and 3, the numeral 14 denotes the lower or plate portion the dual component serving container of this invention and is defined by a rimmed paperboard disc member 40. Disc 40 includes a coplanar, radially outermost edge 42 and a raised rim denoted generally by 44. The raised rim is V-shaped (inverted) in transverse cross-section and includes a radially innermost slanted wall 46 and a radially outermost slanted wall 48, these being integrally joined by a bight portion 50. As indicated at FIG. 2 the wall 46, bight 50 and all of wall 48 and edge 42 are pleated. Pleating of curved radially outermost portions of circular paperboard plates, as for example paperboard picnic plates, is a known technology and hence will not here be described. The overlapped, paperboard hence will not here be described. The overlapped, paperboard pleat lines are denoted by the numeral 54, while the numeral 49 denotes the junction between wall 48 and edge 42.

A plurality of angularly spaced cuts 58 is disposed on the outer V wall 48, each cut extending completely through this wall and each being of a width and height to receive a single one of the tabs 32 positioned at the bottom of crown 10. The cuts are made prior to press forming the plate 14, the press forming operation creating stresses or forces which cause the cuts to open up and form slots, being about 1/16 inch in height. The 45 degree bevel or cuts 36 assist the tab in entering a corresponding slot 58. The width (horizontal extent) of each tab 32 is slightly less than the width of each slot 58. Each wall 46, 48 is slanted from 10 to 15 degrees in the preferred embodiment.

Figure 4:
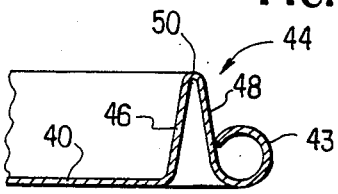
FIG. 4 is a view similar to FIG. 3 and illustrates a modification.

FIG. 4 illustrates an embodiment of the plate 14, wherein coplanar outermost edge 42 is modified so as to assume an upwardly curled configuration 43. This upward curling inhibits delamination of the pleats, such delamination sometimes occurring in the lower members of a stack of plate member 14 due to the weight of the upper members of the stack. In other respects, the construction of the plate 14 of FIG. 4 is the same as the plate of FIGS. 2 and 3.

The number of tabs 32 is greater than the number of slots 58.

The operation of the serving container of this invention is as follows:

In a typical mode of use, a plurality of plate members 14 is placed on a tray prior to fabrication of the food product, such as a hamburger. Next, the lowermost bun (in case of a hamburger) is placed on each plate 14. The building up of the hamburgers is then completed, i.e., meat patties, cheese slices, etc. are stacked to complete each hamburger. Assuming all of the hamburgers for this particular tray are of the same size, a crown member 10 of a corresponding size is selected and placed over each of the plates 14, the crown being pushed down onto outer V wall 48, with each slot 58 becoming engaged with a respective tab 32. The diameter of the crown at bight portions 30 is smaller than that of juncture 49, but is larger than the V rim diameter at bight portion 50. When the crown 10 is pushed over the inverted V wall 48, wall 48 compresses, causing a friction fit and allows for the engagement of tabs 32 into slots 58. Due to manufacturing tolerances and due to changes in the paperboard from which the crown 10 and plate 14 are fashioned, as may be caused for example by temperature and humidity changes, not all of the slots 58 may become engaged with a respective tab 32. However, most of the slots 58, will be engaged to hold the crown and plate together, even in the most severe instance of misalignment of tabs and slots due to the factors just mentioned. For a typical crown of about 5.0 inches diameter at its lower rim, there will be about 45 tabs 32 and the number of slots 58 will be about 8. When engaged, the lower rim of crown 14 rests against edge 42 (FIG. 3) or the lowest portion of curled edge 43 (FIG. 4). The closed volume defined by the interior of the crown and the bottom of the plate functions to retain heat and emit moisture into and through the paperboard to prevent moisture buildup of the hamburger bun. Such retention may be controlled by perforating the crown and/or plate. The tray is then removed from the location where the hamburgers are built to the customer serving area of the store, if desired, from which they are dispensed. In the event that other sizes of hamburgers are to be made, another crown size is selected, using the same size plates 14. The thicker (or thinner) hamburgers are now built, and a different size crown 10 is placed on this tray of hamburgers. The reader will now readily comprehend that only one size plate 14 need be stocked to accommodate different size hamburgers, only different graphically treated crowns, of different height, being required. By virtue of the depressed bottom defined by disc 26, the crowns may be stacked, without sticking or jamming together, and single removal of individual crowns from the stack is possible. Plates 14 are also nestable and stackable by virtue of the inverted V rims interengaging. Plates 14 are also denestable because of the pleats 54 and/or the curl 43 (FIG. 4).

When the consumer receives the serving container, the crown 10 is removed by holding down the plate 14 at its outer edge with the other hand grasping and lifting the crown off of the plate. The crown may be either discarded or used as a container for a salad, french fries, or other food products. Crown 10 may thus perform a dual function. The depressed or false bottom 26 of the crown provides strength when locking it onto the plate 14.

If desired, the exterior surface of disc 26 of crown 10 may be provided with indicia, such as advertising indicia, the same being true for side walls 20. An advantage of S.B.S. board for the crown over all plastic foam containers is its ease in accommodating graphics and its biodegradability.

Generally speaking, the present invention is directed to a serving container for a food product such as a hamburger. The bottom of the container is in the form of a flat paperboard plate having an upstanding rim at its periphery. The top or crown of the container is an inverted cup formed of paperboard. The lower edge of the crown is provided with integral tabs which resiliently and releasably fasten the crown to slots in an upstanding rim of the plate. In addition to its function as a part of the container, the bottom serves as a base upon which the food product may be built. The crown functions to retain heat and emit moisture, and may serve the additional function of a receptacle for another food product, such as french fries or salad, when the serving container is used in a so-called fast food restaurant. In food outlets serving hamburgers of different thicknesses, different height crowns alone need be stocked thus reducing container inventory. By making the number of the crown carried tabs significantly greater than the number of slots on one wall of the plate V rim, engagement of substantially all of the slots is assured regardless of misalignment of slots and tabs from an ideal or desired alignment.

Although the invention has been described above by reference to preferred embodiments, it will be appreciated that other constructions may be devised, which are nevertheless, within the scope and spirit of the invention and are defined by the claims appended hereto.

What is claimed is:

1. A serving container for a food product, such as a hamburger, the container formed of stiff, resilient and foldable sheet material, such as paperboard, the container formed of two parts, being an upper part and a lower part, the lower container part being in the form of a plate, the plate having an upstanding rim near its periphery, a portion of the lower container part extending radially outwardly and beyond the upstanding rim, wherein the radially outwardly portion of the plate limits downward motion of the crown onto the plate, and wherein the upstanding rim includes spaced-apart portions of the sheet material, the outermost one of said spaced-apart portion having a radial extent greater than the radial extent the lower edge of the crown, the upper container part being crown in the form of an inverted cup, the lower edge of the crown and the upstanding rim of the plate releasably fitting together, at least one of the crown and plate being resiliently deformably to effect coupling and uncoupling of the lower edge of the crown from the upstanding rim of the plate, the lower edge of the crown carrying tabs some of which engage complementary slots in the rim, the crown an the plate formed of paperboard, the number of tabs being greater than the number of slots, wherein the plate upstanding rim is inverted V-shaped in transverse cross-section and wherein the complementary slots are formed in the radially outermost wall of the V rim, and wherein the tabs are carried on the inner side of the lower edge of the crown, and wherein both the plate and the crown are round.

2. The serving container of claim 1 wherein the base of the radially outermost wall of the V rim is integral with a horizontally extending outermost plate peripheral portion.

3. The serving container of claim 1 wherein the base of the radially outermost wall of the V rim is integral with an upwardly curled outermost plate peripheral portion.

4. The serving container of claim 1 wherein both walls of the V rim are pleated.

5. The serving container of claim 2 wherein both walls of the V rim and the outermost plate portion are pleated.

6. The serving container of claim 2 wherein both walls of the V rim and the outermost plate portion are pleated.

* * * * *